US007503776B1

(12) United States Patent
Pavlovic et al.

(10) Patent No.: US 7,503,776 B1
(45) Date of Patent: Mar. 17, 2009

(54) GROUNDING CONNECTOR FOR A SHIELDED CABLE

(75) Inventors: Slobodan Pavlovic, Canton, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 11/999,857

(22) Filed: Dec. 7, 2007

(51) Int. Cl.
*H01R 4/66* (2006.01)

(52) U.S. Cl. ..... 439/98; 439/579; 439/455

(58) Field of Classification Search ..... 439/88, 439/92, 98–100, 579; 174/51
See application file for complete search history.

(56) References Cited

U.S. PATENT DOCUMENTS

| | | | | |
|---|---|---|---|---|
| 3,777,050 | A | 12/1973 | Silva | |
| 3,889,046 | A * | 6/1975 | Oberdiear | 174/78 |
| 4,547,623 | A * | 10/1985 | Van Brunt et al. | 174/359 |
| 4,696,649 | A | 9/1987 | Smorzaniuk et al. | |
| 5,597,314 | A | 1/1997 | Auclair et al. | |
| 5,646,370 | A | 7/1997 | Perkins | |
| 6,031,185 | A | 2/2000 | Bouveret et al. | |
| 6,080,018 | A | 6/2000 | Ferrill et al. | |
| 6,186,802 | B1 * | 2/2001 | Masuda et al. | 439/98 |
| 6,254,404 | B1 | 7/2001 | Sedlecky | |
| 6,376,766 | B1 * | 4/2002 | Bartholoma et al. | 174/354 |
| 6,380,485 | B1 * | 4/2002 | Beaman et al. | 174/88 R |
| 6,398,563 | B1 * | 6/2002 | Kanagawa et al. | 439/98 |
| 6,991,493 | B2 | 1/2006 | Matsui et al. | |
| 7,018,220 | B2 * | 3/2006 | Zemba | 439/98 |
| 7,044,756 | B1 | 5/2006 | Asakura et al. | |
| 7,268,298 | B2 | 9/2007 | Asakura et al. | |

* cited by examiner

*Primary Examiner*—Thanh-Tam T Le
(74) *Attorney, Agent, or Firm*—MacMillan, Sobanski & Todd, LLC

(57) ABSTRACT

A grounding connector for a shielded cable having an outer insulated covering, a plurality of paired electrical conductors, and a conductive shield surrounding the paired electrical conductors, the grounding connector includes a connector body having an opening formed therethrough. A conductive grounding pad is disposed within the opening of the connector body. The grounding pad has an inner surface that engages an exposed portion of a conductive shield of a shielded cable, and an outer surface that engages an electrical ground.

9 Claims, 4 Drawing Sheets

GROUNDING CONNECTOR FOR A SHIELDED CABLE

BACKGROUND

Various embodiments of a grounding connector are described herein. In particular, the embodiments described herein relate to an improved grounding connector for a shielded cable.

There is often a need to ground the shield of a shielded electrical cable. Typically this is done by removing an outer insulative cover to expose the shield, then cutting or splitting the tubular shield in a longitudinal direction and attaching an electrically conductive clip to one of the cut portions or flaps of the shield. The shield typically is very thin and relatively delicate aluminum so that the already cut shield is prone to tear during handling.

One existing ground device consists of a braided strap which is ultrasonically welded at one end to an electrically conductive tube. The other end may be connected to a clip where the clip is constructed to be crimped onto one of the flaps of the shield. It is therefore desirable to provide an improved grounding connection for a shielded cable.

SUMMARY

The present application describes various embodiments of a grounding connector for a shielded cable having an outer insulated covering, a plurality of paired electrical conductors, and a conductive shield surrounding the paired electrical conductors. One embodiment of the grounding connector includes a connector body having an opening formed therethrough. A conductive grounding pad is disposed within the opening of the connector body. The grounding pad has an inner surface that engages an exposed portion of a conductive shield of a shielded cable, and an outer surface that engages an electrical ground.

Another embodiment of the grounding connector includes a connector body formed from conductive material. The connector body has an inner surface and an outer surface, the outer surface engaging an electrical ground. A conductive ring engages an exposed portion of a conductive shield of a shielded cable and further engages the inner surface of the connector body.

Other advantages of the grounding connector will become apparent to those skilled in the art from the following detailed description, when read in light of the accompanying drawings.

DETAILED DESCRIPTION

Figure 1:
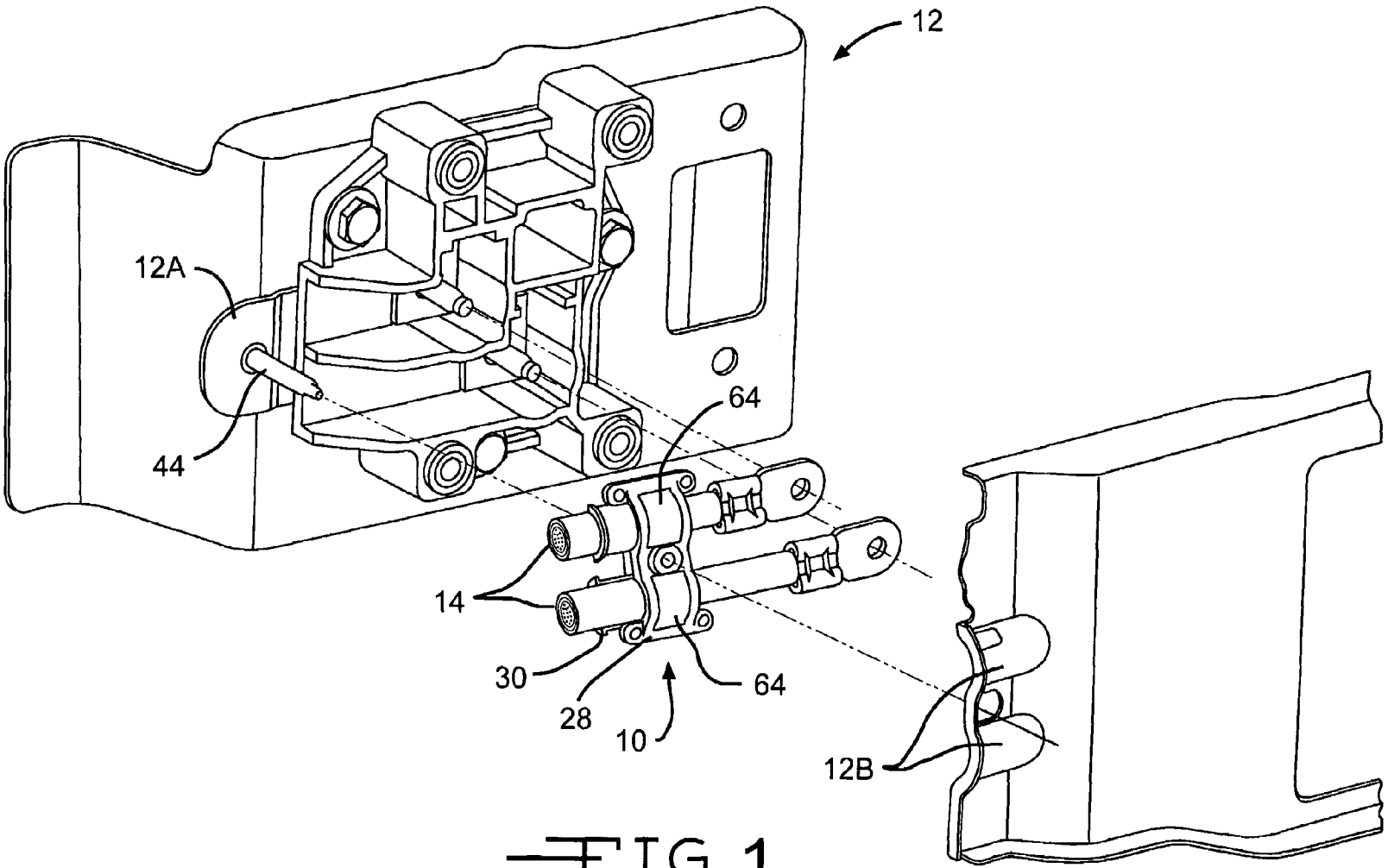
FIG. 1 is a perspective view of a first embodiment of a grounding connector attached to a pair of high voltage cables and attached to a device housing.

Referring now to the drawings, there is illustrated in FIG. 1 a first embodiment of a grounding connector for a shielded cable, indicated generally at 10, and shown attached to a ground terminal or device housing 12. In the illustrated embodiment, the device housing 12 is a high voltage battery housing. Alternatively, the device housing 12 may be any other desired ground terminal or device housing.

Figure 4:
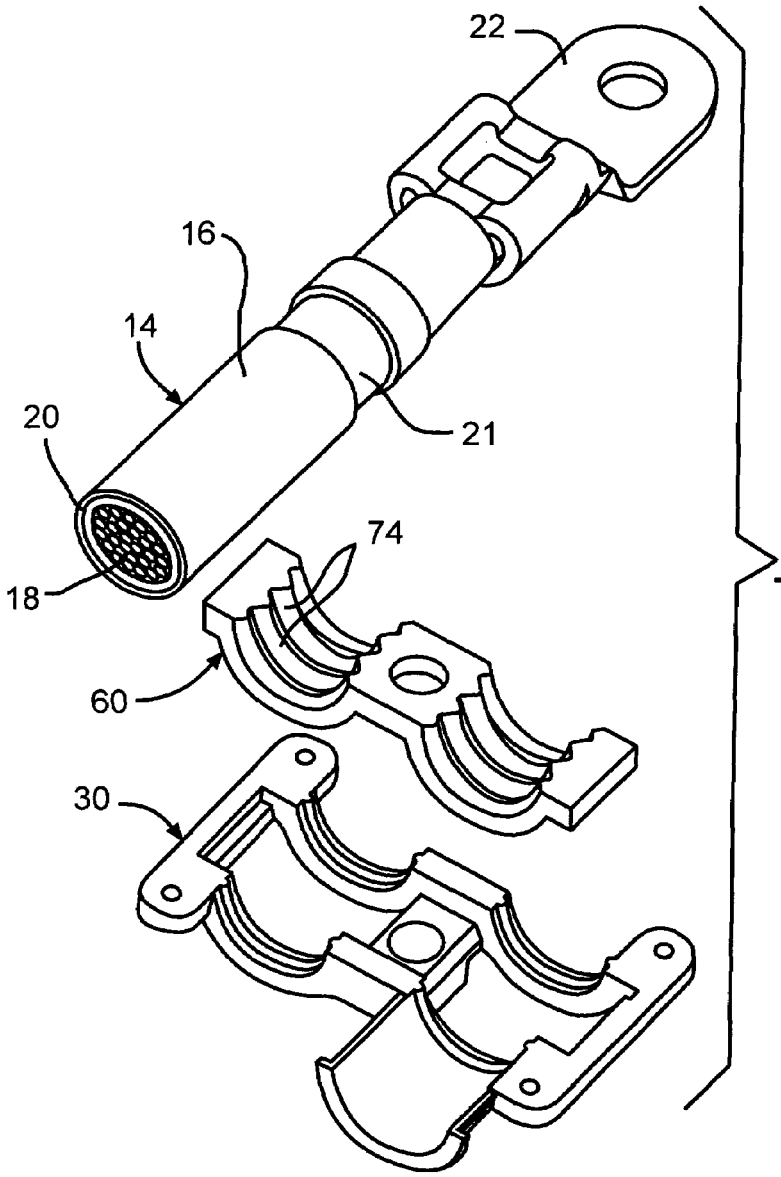
FIG. 4 is an enlarged exploded view of a portion of the grounding connector illustrated in FIGS. 1 through 3.

The illustrated connector 10 is shown attached to a pair of high voltage shielded cables 14, such as cables for connecting a high voltage battery to a power supply or inverter (not shown). Alternatively, the connector 10 may be used with single cables. In the exemplary embodiment illustrated in FIG. 4, each of the pair of shielded cables 14 includes an outer insulated covering 16, a plurality of paired electrical conductors 18, and a conductive shield 20 surrounding the paired conductors 18. Each of the cables 14 terminates in flat ring terminal 22. As best shown in FIG. 4 a circumferential portion of the insulated covering 16 has been removed, exposing a portion 21 of the conductive shield 20. It will be understood that the grounding connector 10 described herein may be used with any desired type of high voltage shielded cables.

Figure 3:
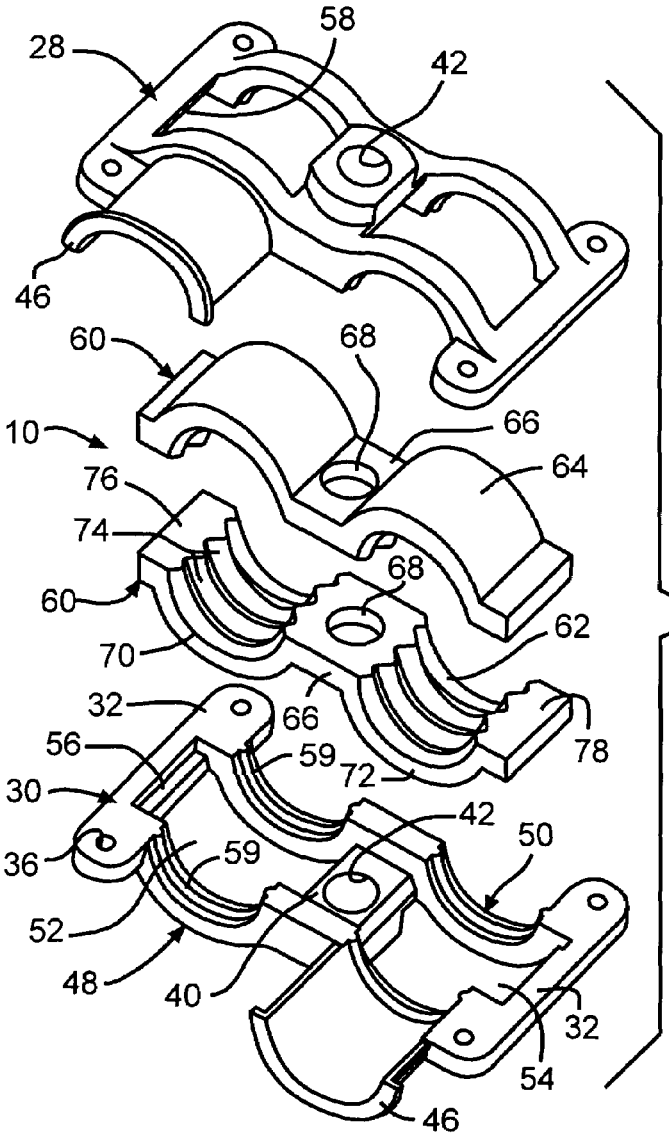
FIG. 3 is an enlarged exploded view of the grounding connector illustrated in FIGS. 1 and 2.

Referring now to FIG. 3, the connector 10 may include a connector body 24 formed from non-conductive material and having first and second openings, 52 and 54 respectively, formed therethrough. The illustrated connector body 24 includes a first body portion 28 and second body portion 30. The second body portion 30 is substantially identical to the first body portion 28.

Figure 2:
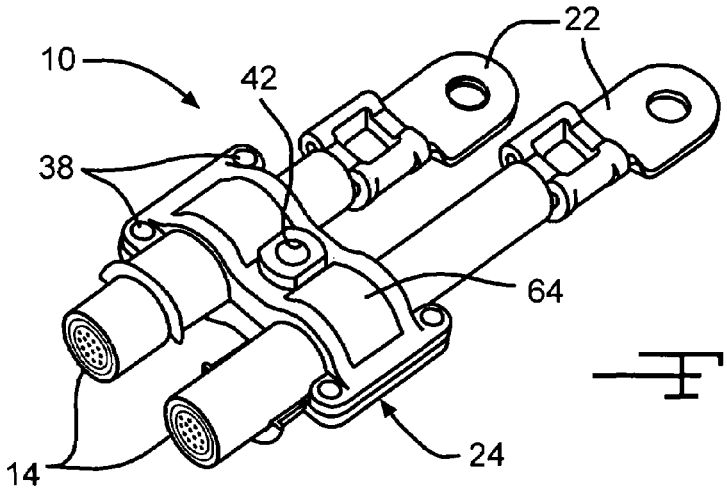
FIG. 2 is an enlarged perspective view of the grounding connector illustrated in FIG. 1.

The first and second body portions 28 and 30 include a first flange 32 and second flange 34, each with a plurality of first apertures 36 for receiving fasteners 38. The fasteners 38 may be any fastener, such as rivets 38 as shown in FIG. 2. Alternatively, any desired fastener, such as for example, threaded fasteners and the like. A central portion 40 of the first body portion 28 includes a second aperture 42 for mounting the grounding connector 10 to a boss 44 of a device housing 12, as best shown in FIG. 1. The first body portion 28 may include an outwardly extending sleeve portion 46 for engaging and supporting a portion of one of the pair of cables 14.

A first semi-cylindrical portion 48 is defined between the first flange 32 and the central portion 40. Similarly, a second semi-cylindrical portion 50 is defined between the second flange 34 and the central portion 40. In the illustrated embodiment, the opening 26 includes a first opening 52 formed in the first semi-cylindrical portion 48 and a second opening 54 formed in the second semi-cylindrical portion 50. In the illustrated embodiment, a first step 56 is defined in the first flange 32, and is structured and configured for receiving a grounding pad 60, as described in detail herein below. Similarly, a second step 58 is defined in the second flange 34, and is structured and configured for receiving the grounding pad 60. Ribs 59 may be formed on an inner surface of the first and second semi-cylindrical portions 48 and 58 adjacent the first and second openings 52 and 54, respectively. The first body portion 28 may be formed from plastic, such as for example, high temperature polyamide (PA), polyphthalamide (PPA), or other desired high temperature resistant thermoplastic material.

The grounding pad 60 may be disposed within the first and second openings 52 and 54 of the connector body 24. The grounding pad 60 has an inner surface 62 which engages and is in contact with the exposed portion 21 of the shield 20 of each of the pair of shielded cables 14. The grounding pad 60 also includes an outer surface 64 which engages a device housing 12.

The grounding pad 60 further includes a central portion 66 having an aperture 68 axially aligned with the second apertures 42 of the first and second body portions 28 and 30. A first semi-cylindrical portion 70 is defined between a first flange 76 and the central portion 66. Similarly, a second semi-cylindrical portion 72 is defined between a second flange 78 and the central portion 66. In the illustrated embodiment, an inner surface of the first and second semi-cylindrical portions 70 and 72 define a plurality of ribs 74 for engaging the exposed portion 21 of the cable shield 20. The grounding pad 60 may be formed from any desired conductive material, such as for example, silicone rubber filled with conductive fibers and/or conductive particles. Examples of conductive fibers and/or conductive particles include silver, copper, nickel, nickel plated copper, nickel plated glass, steel, and any other desired conductive fiber and/or conductive particle.

Advantageously, the grounding connector 10 provides 360 degree circumferential contact between the grounding pad 60 and the exposed portion 21 of the shield 20. The grounding pad 60 is further in contact with the device housing 12 and thereby optimizing the grounding connection. For example, in the illustrated embodiment, the outer surface 64 on one side of the connector 10 (e.g. the outer surface 64 extending through the second body portion 30 when viewing FIG. 1) engages and is in contact with a first portion 12A of the device housing 12. An outer surface 64 on an opposite side of the connector 10 (e.g. the outer surface 64 extending through the first body portion 28 when viewing FIG. 1) engages and is in contact with a second portion 12B of the device housing 12.

Figure 5:
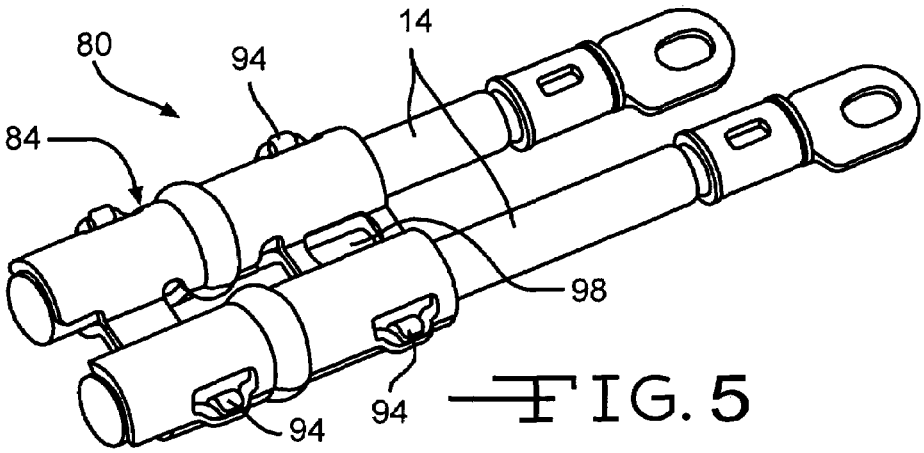
FIG. 5 is a perspective view of a second embodiment of a grounding connector attached to a pair of high voltage cables.
Figure 6:
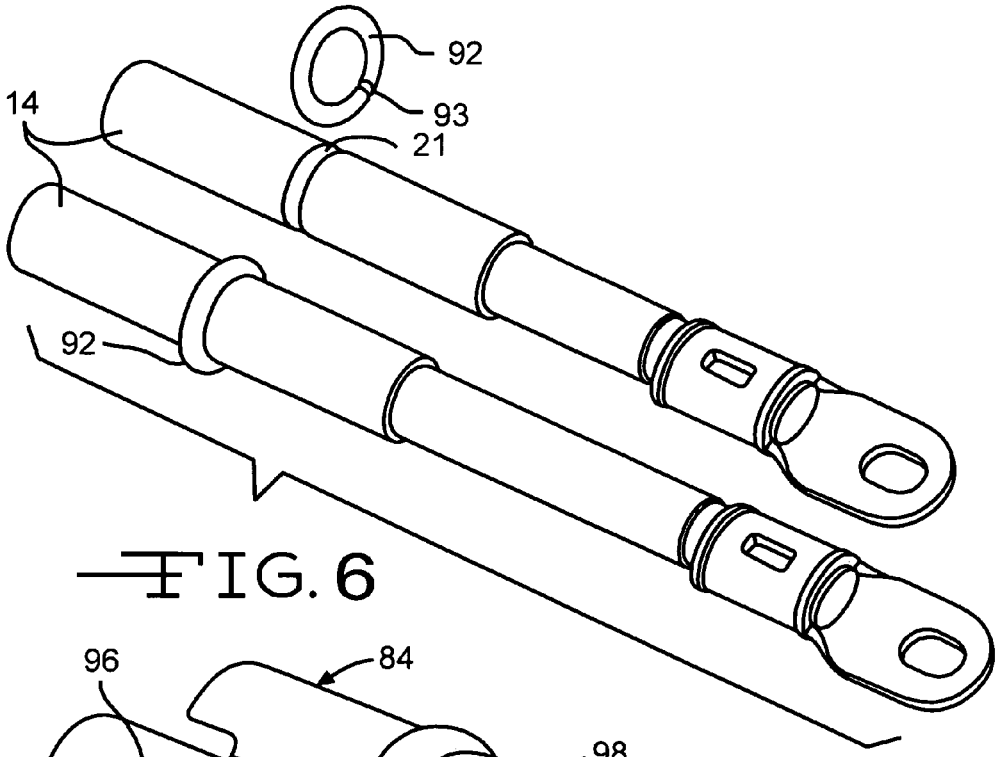
FIG. 6 is a perspective view of a portion of the grounding connector illustrated in FIG. 5 attached to a pair of high voltage cables.
Figure 7:
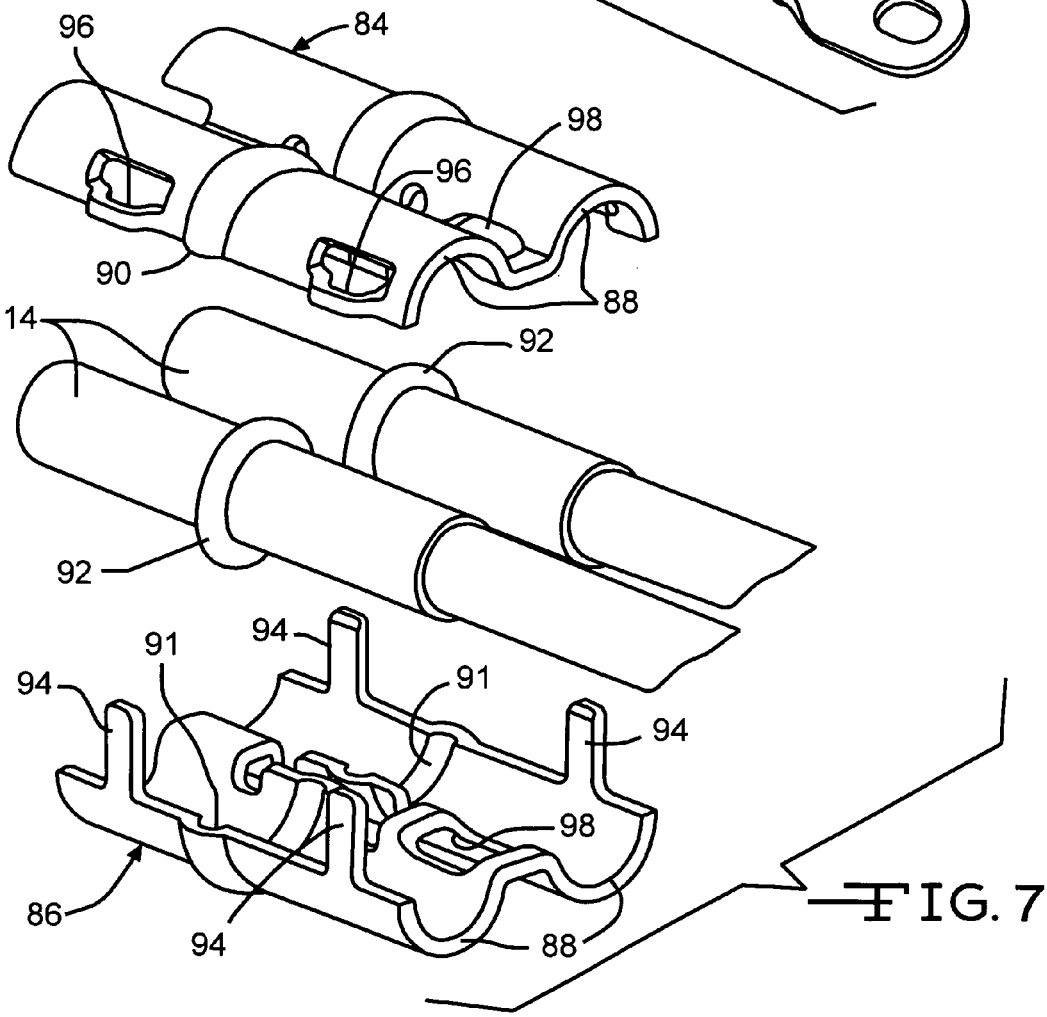
FIG. 7 is an exploded view of the grounding connector illustrated in FIG. 5.

Referring now to FIGS. 5 through 7, there is illustrated a second embodiment of a grounding connector for a shielded cable, indicated generally at 80. The illustrated connector 80 is shown attached to the pair of high voltage shielded cables 14. Alternatively, the connector 80 may be used with single cables. As described herein above and best illustrated in FIG. 4, each of the illustrated pair of shielded cables 14 includes an outer insulated covering 16, a plurality of paired electrical conductors 18, and a conductive shield 20 surrounding the paired conductors 18. As best shown in FIG. 6 a circumferential portion of the insulated covering 16 has been removed, exposing the portion 21 of the conductive shield 20.

As best shown in FIG. 7, the connector body 82 includes a first body portion 84 and second body portion 86. The first body portion 84 (the upper portion when viewing FIG. 7) includes a pair of substantially parallel semi-cylindrical portions 88, structured and configured for receiving a portion of each of the pair of shielded cables 14. Each of the semi-cylindrical portions 88 includes a transversely extending circumferential groove 90 for receiving an O-ring 92, as will be described in detail below.

The second body portion 86 (the lower portion when viewing FIG. 7) includes a pair of substantially parallel semi-cylindrical portions 86, structured and configured for receiving a portion of each of the pair of shielded cables 14. Each of the semi-cylindrical portions 86 includes a transversely extending circumferential groove 91 for receiving the O-ring 92. The illustrated second body portion 86 includes two pair of outwardly extending (upwardly extending when viewing FIG. 7) fastening arms 94. Alternatively, the second body portion 86 may include any desired number of outwardly extending fastening arms 94.

The first body portion 84 also includes a plurality of openings 96 for receiving each of the fastening arms 94. An O-ring 92 is disposed about the exposed portion of the conductive shield 20. The O-ring 92 may include a slit 93 for ease of installation. The O-ring 92 may be formed from any desired conductive material, such as for example, silicone rubber filled with conductive fibers and/or conductive particles. Examples of conductive fibers and/or conductive particles include silver, copper, nickel, nickel plated copper, nickel plated glass, steel, and any other desired conductive fiber and/or conductive particle.

In the illustrated embodiment, the first and second body portions 84 and 86 are formed from conductive material, such as for example steel. Alternatively, the first and second body portions 84 and 86 may be formed from plastic material filled with conductive fibers and/or particles. Examples of such conductive plastic material include high-temperature resistant PA, PPA, or other desired high-temperature resistant thermoplastic materials filled with conductive fibers and/or particles. Examples of conductive fibers and/or conductive particles include silver, copper, nickel, nickel plated copper, nickel plated glass, steel, and any other desired conductive fiber and/or conductive particle. The first and second body portions 84 and 86 may also be formed from any other desired conductive metals and non-metals.

Advantageously, the grounding connector 80 provides 360 degree circumferential contact between the O-ring 92 and the exposed portion of the shield 20. The O-ring 92 is further in contact with the grooves 90 and 91 of the first and second body portions 84 and 86, respectively, thereby optimizing the grounding connection between the cable shield 20 and the connector body 82.

Once the first and second body portions 84 and 86 are assembled to one another, the fastening arms 94 crimped or bent outwardly, thereby joining the first and second body portions 84 and 86 to one another, as shown in FIG. 5.

The connector body 82 may include a mounting slot or aperture 98 formed through the connector body 82 for mounting the grounding connector 80 about a boss, such as the boss 44 illustrated in FIG. 1, of the device housing 12. Alternatively, the aperture 98 may receive a fastener, such as a threaded fastener (not shown) for attaching the grounding connector 80 to a device housing.

When mounted to a device housing 12, the connector body 82 is further in contact with the device housing 12, thereby optimizing the grounding connection from the cable shield 20, through the O-ring 92, through the connector body 82, to the device housing 12.

The principle and mode of operation of the grounding connector for a shielded cable have been described in its various embodiments. However, it should be noted that the grounding connector described herein may be practiced otherwise than as specifically illustrated and described without departing from its scope.

What is claimed is:

1. A grounding connector for a shielded cable having an outer insulated covering, a plurality of paired electrical conductors, and a conductive shield surrounding the paired electrical conductors, the grounding connector comprising:

a connector body formed from conductive material and having an inner surface and an outer surface, the outer surface engaging an electrical ground; and a conductive ring engaging an exposed portion of the conductive shield of a shielded cable and engaging the inner surface of the connector body;

wherein the inner surface of the connector body defines a substantially cylindrical opening for receiving the shielded cable;

wherein an inner surface of the substantially cylindrical opening includes a circumferentially extending groove in 360 degree circumferential contact with an outer surface of the conductive ring; and wherein the circumferentially extending groove in the inner surface of the connector body defines a circumferential ridge extending outwardly of the outer surface of the connector body, a portion of the circumferential ridge engaging an electrical ground.

2. The grounding connector according to claim 1, wherein the conductive ring is formed of resilient material.

3. The grounding connector according to claim 1, wherein the conductive ring is formed of silicon.

4. The grounding connector according to claim 1, wherein the conductive ring includes a slit.

5. The grounding connector according to claim 1, wherein the shielded cable includes a pair shielded cables, wherein the grounding connector includes a pair of conductive rings, and wherein the inner surface of a conductive ring engages an exposed portion of the conductive shield of each of the pair of shielded cables.

6. The grounding connector according to claim 1, wherein the electrical ground is a device housing.

7. The grounding connector according to claim 1, wherein the exposed portion of the conductive shield is exposed about the entire circumference of the shielded cable, and wherein the conductive ring is in 360 degree circumferential contact with the exposed portion of the conductive shield.

8. A grounding connector for a shielded cable comprising:

a connector body formed from conductive material and having an inner surface and an outer surface; and a conductive ring engaging an exposed portion of a conductive shield of a shielded cable and engaging the inner surface of the connector body;

wherein an inner surface of the connector body includes a circumferentially extending groove in 360 degree circumferential contact with an outer surface of the conductive ring; and wherein the circumferentially extending groove in the inner surface of the connector body defines a circumferential ridge extending outwardly of the outer surface of the connector body, a portion of the circumferential ridge engaging an electrical ground.

9. A grounding connector and a shielded cable comprising:

a connector body formed from conductive material and having an inner surface and an outer surface;

a shielded cable disposed within the connector body; and a conductive ring engaging an exposed portion of a conductive shield of the shielded cable and engaging the inner surface of the connector body;

wherein an inner surface of the connector body includes a circumferentially extending groove in 360 degree circumferential contact with an outer surface of the conductive ring; and wherein the circumferentially extending groove in the inner surface of the connector body defines a circumferential ridge extending outwardly of the outer surface of the connector body, a portion of the circumferential ridge engaging an electrical ground.

* * * * *